US006824010B1

(12) United States Patent
Erikawa

(10) Patent No.: US 6,824,010 B1
(45) Date of Patent: Nov. 30, 2004

(54) SELECTIVE ACTUATING APPARATUS

(75) Inventor: Hajime Erikawa, Saitama-ken (JP)

(73) Assignee: Fuji Electric Co., Ltd., Kanagawa (JP)

( * ) Notice: Subject to any disclaimer, the term of this patent is extended or adjusted under 35 U.S.C. 154(b) by 114 days.

(21) Appl. No.: 09/672,900

(22) Filed: Sep. 29, 2000

(30) Foreign Application Priority Data

Sep. 29, 1999 (JP) ..... 11-276771

(51) Int. Cl.[7] ..... B65H 3/28; G07F 11/16

(52) U.S. Cl. ..... 221/221; 221/222; 221/223; 221/297; 221/298; 192/45.1

(58) Field of Search ..... 221/221, 222, 221/223, 297, 298; 180/337; 192/45.1

(56) References Cited

U.S. PATENT DOCUMENTS 601,205 A * 3/1898 Hill ..... 180/293
1,437,501 A * 12/1922 Duffield ..... 97/47
1,461,997 A * 7/1923 Armstrong ..... 180/293
1,881,067 A * 10/1932 Summers ..... 180/293
1,947,988 A * 2/1934 Hedgeland ..... 180/293
2,026,444 A * 12/1935 Trott ..... 180/293

(List continued on next page.)

*Primary Examiner*—Donald P. Walsh
*Assistant Examiner*—Michael E. Butler
(74) *Attorney, Agent, or Firm*—McDermott Will & Emery LLP

(57) ABSTRACT

A selective actuating apparatus involves a barrel 17 rotated due to rotation of a driving motor 2, a revolving shaft 3A supporting rotatably the barrel 17, and a barrel 16 rotated as a result of transmitting torque in the case where the barrel 17 is rotated in a direction b indicated by an arrow wherein a cam section 16B is defined on the barrel 16. In this condition, when the barrel 17 rotates in a direction a indicated by an arrow, the torque does not transmit to the barrel 16, but the barrel 16 is allowed to displace along the revolving shaft 3A due to sliding motion in between a projection 16A formed on the barrel 16 and a projection 17D formed on the inner circumference of the barrel 17 in a stepped manner. As a result, the selective actuating apparatus by which a plurality of driving objects can be driven without requiring a plurality of driving sources, so that its driving system can be downsized is obtained.

3 Claims, 12 Drawing Sheets

U.S. PATENT DOCUMENTS 2,040,035 A * 5/1936 Trott ..... 180/293
2,061,006 A * 11/1936 Parker ..... 180/293
2,090,262 A * 8/1937 Montgomery et al. ..... 29/37
2,097,204 A * 10/1937 Wemp ..... 180/293
2,433,736 A * 12/1947 Carew ..... 312/44
2,497,718 A * 2/1950 Early et al. ..... 312/44
2,571,283 A * 10/1951 Micholson ..... 225/21
3,119,281 A * 1/1964 Gerber et al. ..... 74/655
3,724,300 A * 4/1973 Bardiau ..... 82/3
3,753,657 A * 8/1973 Downing et al. ..... 23/253
3,819,086 A * 6/1974 Paolucci ..... 221/11
4,042,148 A * 8/1977 Gerben ..... 221/222
4,154,121 A * 5/1979 Yamasaki ..... 74/141
4,361,176 A * 11/1982 West ..... 141/362
4,558,802 A * 12/1985 Molison ..... 221/11
4,714,147 A * 12/1987 Szodfridt et al. ..... 192/87.15
4,727,965 A * 3/1988 Zach et al. ..... 192/6
4,873,893 A * 10/1989 Blakemore ..... 74/752
4,909,365 A * 3/1990 Tillotson et al. ..... 192/35
5,070,978 A * 12/1991 Pires ..... 192/45.1
5,197,376 A * 3/1993 Bird et al. ..... 99/330
5,393,292 A * 2/1995 Sand ..... 493/76
5,404,796 A * 4/1995 Campbell et al. ..... 99/357
5,449,057 A * 9/1995 Frank ..... 192/46
5,538,749 A * 7/1996 Shimp ..... 426/589
5,556,354 A * 9/1996 Meier-Burkamp ..... 475/275
5,597,057 A * 1/1997 Ruth et al. ..... 192/46
5,638,933 A * 6/1997 Matsumoto et al. ..... 192/52.5
5,729,126 A * 3/1998 Komoda et al. ..... 475/150
5,730,269 A * 3/1998 Hersey ..... 192/105
5,823,845 A * 10/1998 O'Berrigan ..... 446/234
5,896,969 A * 4/1999 Meier-Burkamp ..... 192/64
5,927,455 A * 7/1999 Baker et al. ..... 192/36
5,964,331 A * 10/1999 Reed et al. ..... 192/46
5,992,592 A * 11/1999 Showalter ..... 192/43.1
6,239,503 B1 * 5/2001 Ikeda et al. ..... 290/38 R
6,386,349 B1 * 5/2002 Welch ..... 192/43
6,533,054 B1 * 3/2003 Fey ..... 180/65.3
6,550,638 B1 * 4/2003 Mochida ..... 221/124
6,575,275 B2 * 6/2003 Muramatsu et al. ..... 192/3.21
6,575,280 B2 * 6/2003 Ballew et al. ..... 192/46

* cited by examiner

SELECTIVE ACTUATING APPARATUS

FIELD OF THE INVENTION

The present invention relates to a selective actuating apparatus, and particularly to a selective actuating apparatus by which common use of a driving source is achieved to simplify its driving system and to reduce a cost therefor.

BACKGROUND OF THE INVENTION

FIG. 12(*a*) shows a cup feeding section 5 in a conventional automatic vending machine for dispensing cup-shaped containers (hereinafter referred optionally to as "cups") composed of cup dispensing sections 5A, 5B and 5C for each dispensing a cup 24, due to a rotating operation of barrels 51 each outer circumference of which is defined a spiral groove and each prepared dependent upon cup sizes (S, M, L); levers 52 each of which is integrally mounted to each of rings (to be undermentioned) for driving rotatively a barrel 51; driving motors 2 for each rotating in case of an operation for dispensing a cup; torque transmitting sections 3 for each transmitting a torque of the driving motor 2 to each of rotational members 55; and connection members 54 for each connecting each lever 52 with each rotational member 55 by means of each of pins 53 wherein a revolving movement produced in each of the rotational members 55 by driving each of the driving motors 2 is converted into a reciprocating motion to transmit the same to each of the levers 52.

FIG. 12(*b*) shows the barrel 51 wherein the ring 52A rotates in a direction indicated by the arrow A', when the connection member 54 mounted integrally to the lever 52 connected with the pin 53 shifts along a direction indicated by the arrow A. The ring 52A contains on the inner circumference thereof a gear 52B engaging with a gear 51A mounted on a revolving shaft of the barrel 51 wherein when the ring 52A rotates in the direction indicated by the arrow A', the barrel 51 rotates along a direction indicated by the arrow $r_1$. Furthermore, when the connection member 54 shifts to a direction indicated by the arrow B, the ring 52A rotates in a direction indicated by the arrow B' thereby to rotate the barrel 51 in a direction indicated by the arrow $r_2$. Due to the rotation of the barrel 51 in the direction $r_1$, an edge portion 24A of a cup 24 positioned at the lowest position is held in a spiral groove, and in this condition, when the barrel is rotated in the direction $r_2$, the edge portion 24A is transferred to the lower side of the barrel 51 on the surface of the drawing. As a result, the lowest cup is separated from a stacked layer of the cups 24 to be dispensed downwards.

However, according to a conventional automatic vending machine for dispensing cup-shaped containers, since independent driving systems are provided in every cup dispensing sections, there is such a problem that the number of parts increase, because motors, wirings, and driving circuits are required for the every driving systems, whereby the resulting driving systems become large-sized.

SUMMARY OF THE INVENTION

Accordingly, it is an object of the present invention to provide a selective actuating apparatus by which a plurality of objects to be driven can be driven without requiring a plurality of driving sources, whereby a downsized driving system is achieved.

In order to achieve the above described object, a selective actuating apparatus, according to the feature of the invention, wherein one of a plurality of actuating members disposed with a predetermined spacing in a predetermined direction is selected, and the one actuating member is actuated due to a torque obtained by a single motor, comprises:

- a first rotating member rotated by the torque transmitted;
- a second rotating member disposed coaxially with respect to the first rotating member;
- a free wheeling clutch means placed in between the first rotating member and the second rotating member and transmitting the torque of the first rotating member to the second rotating member in the case when the first rotating member rotates in a first rotating direction; and
- a displacing means disposed in between the first rotating member and the second rotating member and displacing the second rotating member with the predetermined spacing in the predetermined direction due to a rotating operation of the first rotating member in the case when the first rotating member rotates in a second rotating direction;
- the second rotating member selecting the one actuating member at a position in the predetermined direction determined as a result of displacement by the displacing means, and being constituted so as to actuate the one actuating member by means of the torque transmitted through the free wheeling clutch means.

According to the above described selective actuating apparatus, the free wheeling clutch means transmits the torque to the second rotating member in the case when the first rotating member rotates in the first rotating direction, whereby the second rotating member rotates, while the free wheeling clutch means does not transmit the torque to the second rotating member in the case when the first rotating member rotates in the second rotating direction, whereby the second rotating member is displaced with the predetermined spacing in the predetermined direction. Thus, either of two motions is conducted on the basis of switching rotating directions of a single motor, whereby common use of the motor can be achieved.

According to the selective actuating apparatus as described in the above paragraph as to the feature of the invention, wherein the displacing means contains a stepped part defined in a stepped contour with a step corresponding to the predetermined spacing on the inner circumference of the first rotating member, and a projecting part defined on the outer circumference of the second rotating member which engages with the stepped part; the first rotating member is rotated in the case when it is rotated in the second rotating direction in a condition where no torque is transmitted to the second rotating member as a result of uncoupling of the free wheeling clutch means, while the first rotating member displaces the second rotating member with the predetermined spacing in the predetermined direction as a result of sliding the projecting part defined on the second rotating member along the stepped part.

According to the selective actuating apparatus as described in the above paragraph as to the feature of the invention, wherein the second rotating member is provided with a cam section for displacing the one actuating member against elastic force in a direction intersecting the predetermined direction at right angles as a result of rotating the second rotating member in the first rotating direction.

According to the selective actuating apparatus as described in the above paragraph as to the feature of the displacing means of the invention, wherein the first rotating member contains a wall surface formed by an inclined plane extending from the highest step to the lowest step in the stepped part.

BRIEF DESCRIPTION OF THE DRAWINGS

The present invention will be explained in more detail in conjunction with appended drawings, wherein:

FIG. 1(*b*) is a perspective view showing a cup feeding section according to a first embodiment of the invention;

FIG. 2(*b*) is a side view illustrating a cup feeding operation of the cam driving section;

FIG. 11(*b*) is a side view showing the cup shifting mechanism according to the second embodiment of the invention;

FIG. 11(*c*) is an explanatory view illustrating an operation of a push-up member;

FIG. 11(*d*) is an explanatory view illustrating an operation of the push-up member;

FIG. 12(*b*) is an explanatory view showing partly a driving mechanism for the cap feeding section.

DESCRIPTION OF THE PREFERRED EMBODIMENTS

A selective actuating apparatus according to the present invention will be described in detail hereinafter by referring to the accompanying drawings.

Figure 1:
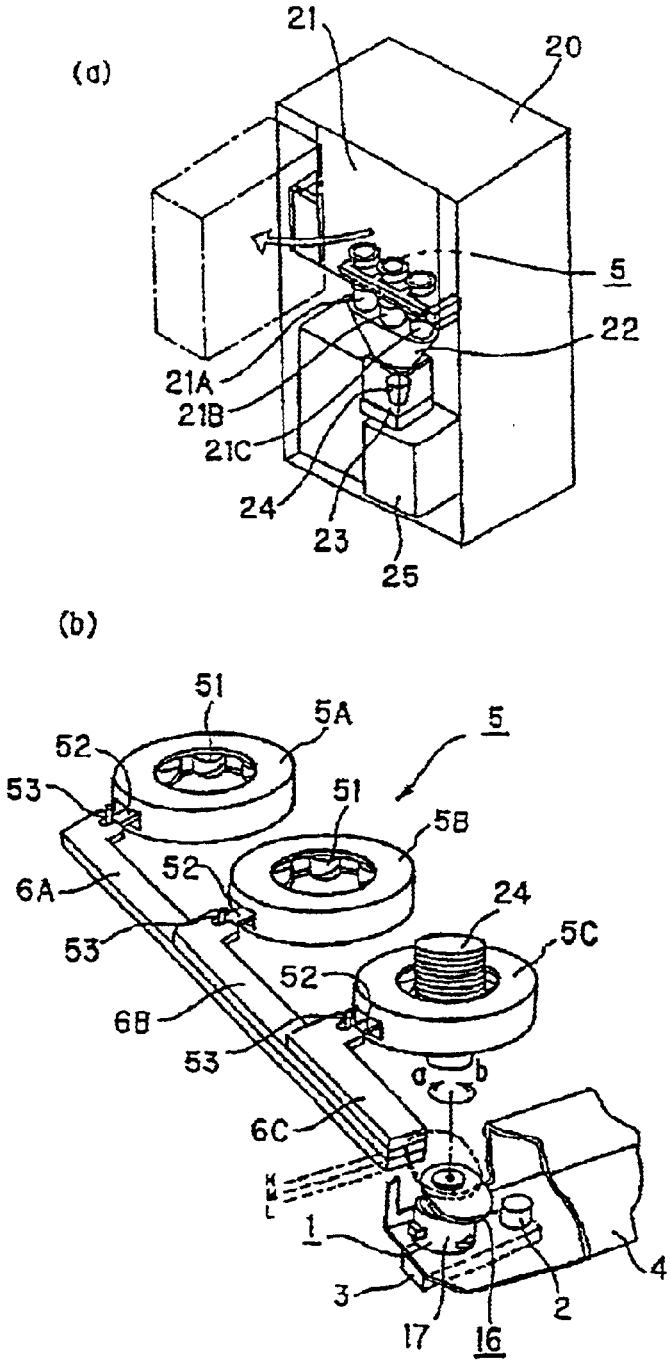
FIG. 1(*a*) is an explanatory view showing an automatic vending machine for dispensing cup-shaped containers according to an embodiment of the present invention.

FIG. 1(*a*) shows an automatic vending machine for dispensing cup-shaped containers comprising a cup feeding section 21 contained inside a main body 20 at the upper part thereof, a port for dropping a cup 21A (hereinafter referred to simply as "cup dropping port"), a cup dropping port 21B, and a cup dropping port 21C disposed at the lower part of the cup feeding section 21 dependent on sizes S, M, and L of cup, a cup supplying section 5 prepared in response to the cup dropping ports 21A, 21B and 21C and for separating a bundle of cups contained in the cup feeding section in a stacked condition in a layer in every cup sizes S, M and L into a single cup one by one to deliver the same to the cup dropping ports 21A, 21B and 21C, respectively, a cup chute 22 formed long sideways so as to cover the cup dropping ports 21A, 21B and 21C the whole contour of which is flat hopper-shaped, a cup stage 23 on which a cup 24 supplied through the cup chute 22 is placed, and a drainage bucket 25 disposed in the lower part of the cup stage 23 and receiving beverage and the like overflowed from the cup 24.

FIG. 1(*b*) shows the cup supplying section 5 according to a first embodiment of the invention which comprises cup dispensing sections 5A (cup size L), 5B (cup size M) and 5C (cup size S) prepared in response to cup sizes (S, M, L), respectively, and dispensing a cup 24 due to rotational operation of barrels 51 each having a spiral groove on the outer circumference thereof; levers 52 each mounted integrally to each ring (not shown) for rotatively driving the barrels 51; a cam driving section 1 having another barrel 17 rotated as a result of transmitting a torque produced by the driving motor 2 through a torque transmitting section 3, and a further barrel shifting in the perpendicular direction due to rotation in a direction indicated by the arrow a of the barrel 17, while rotating together with the barrel 17 due to rotation in a direction indicated by the arrow b; a frame containing integrally the driving motor 2, the torque transmitting section 3, the barrel 16 and the barrel 17; and sliders 6A, 6B and 6C for driving pins 53 fixed to the levers 52 in the cup dispensing sections 5A, 5B and 5C, respectively, by means of reciprocating motion due to rotational operation of the barrel 16 wherein the sliders 6A, 6B and 6C are formed by stacking plate-like members in a layer, and energized by a spring (not shown) in the direction towards the barrel 16, and one hand, the driving motor 2 is a DC motor rotated in a predetermined direction by switching an energized polarity.

Figure 2:
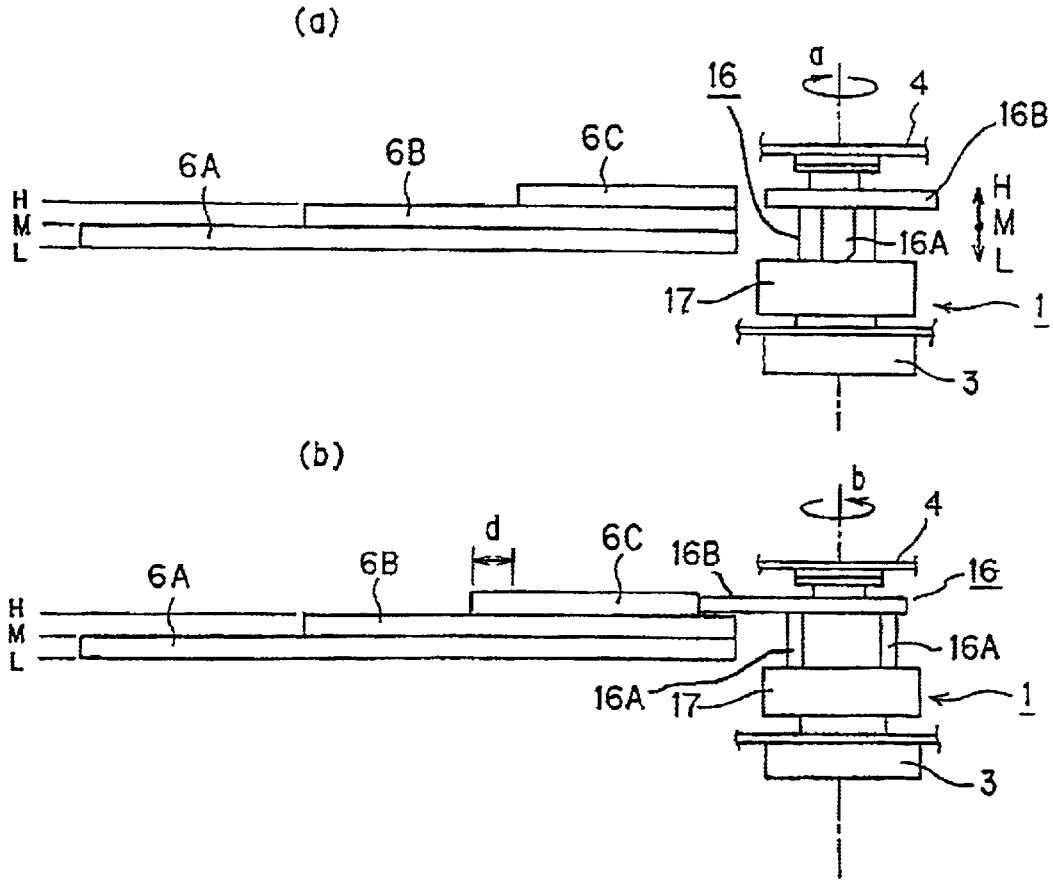
FIG. 2(*a*) is a side view illustrating a driving position selecting operation for a cam driving section.

FIG. 2(*a*) illustrates an operation for selecting a driving position of the cam driving section 1 wherein when the barrel 17 is rotated in the direction a, the barrel 16 shifts in the vertical direction in the order of positions L, M and H due to torque transmitted through the torque transmitting section 3 in an undriven state, so that the barrel 16 lowers from the position H to the position L. In the same figure, the barrel 16 rests on the position H.

FIG. 2(*b*) illustrates an operation for feeding a cup in the cam driving section 1 wherein when the barrel 17 is rotated in the direction b, the barrel 16 rotates due to a torque transmitted through the torque transmitting section 3. In the same figure, when the barrel 16 pushes the slider 6C at the position H, an amount of travel d corresponding to an amount of eccentricity of the barrel 16 produces.

Figure 3:
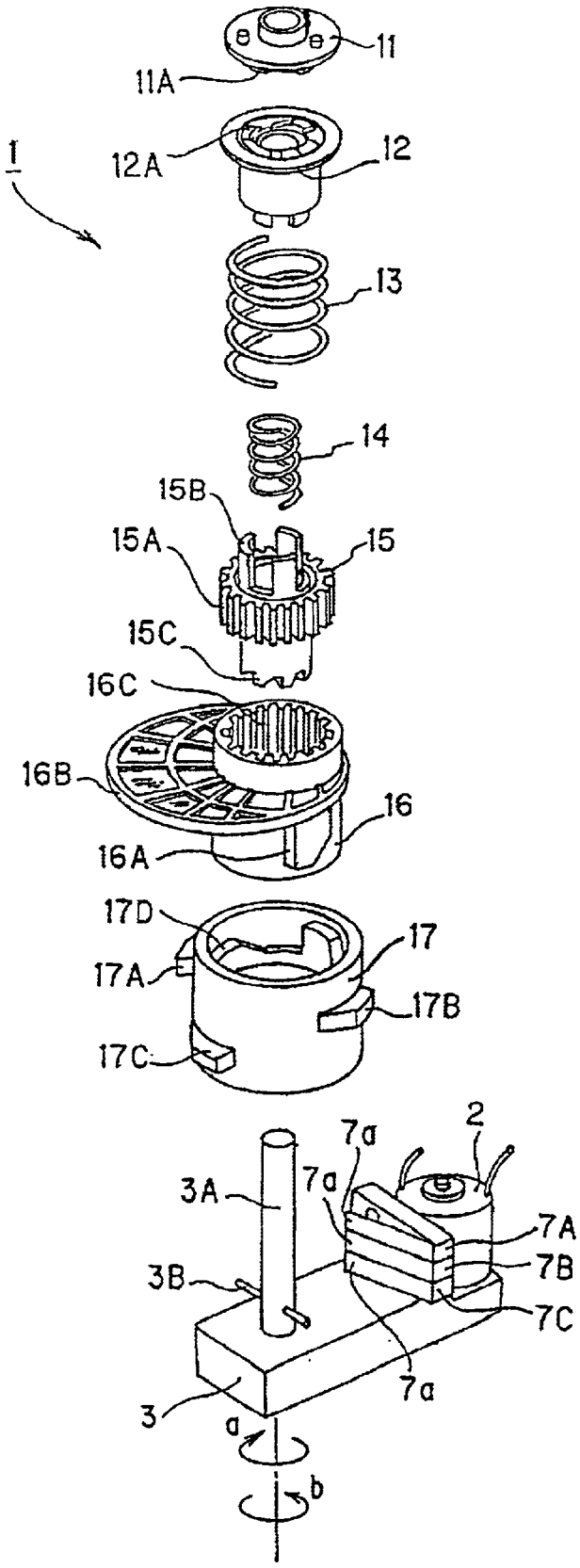
FIG. 3 is an exploded view showing the cam driving section according to the first embodiment of the present invention.

FIG. 3 is an exploded view showing the cam driving section 1 which comprises a stopper 11 secured to the frame 4 (not shown) and having saw-toothed engaging projections formed by a vertical surface and an inclined surface on the lower part thereof in an annular form (hereinafter referred to simply as "engaging projections") 11A; a barrel 12 containing engaging projections 12A engaging with the engaging projections 11A of the stopper 11; a barrel 15 having a spline 15A defined on the outer circumference thereof, a comb-shaped annular projection 15B engaging with a comb-shaped annular projection 12B (which will be mentioned hereunder) defined on the barrel 12, and engaging projections 15C formed on the lower part thereof in an annular form; a spring 14 held by the barrel 12 as well as the barrel 15 in between them; the barrel 16 having a projection 16A, a cam section 16B, and a spline 16C; a spring 13 mounted in between the barrel 12 and the barrel 16 to energize the barrel 16 downwards; the barrel 17 having projections 17A, 17B and 17C for operating a switch disposed at a predetermined position on the outer circumference thereof and a projection 17D engaging with the projection 16A of the barrel 16 and disposed on the inner circumference thereof, and further containing the barrel 16, a revolving shaft 3A engaged with the barrel 17 by means of an engaging pin 3B and transmitting a torque due to rotation of the driving motor 2 to the barrel 17 to rotate the same; and switches 7A, 7B and 7C for generating energization stopping signal as a result of operating a switch plate 7*a* being in contact with the projections 17A, 17B and 17C, respectively, defined on the barrel 17. As an alternative constitution of the switches 7A, 7B and 7C, such a constitution that an amount of rotation in the barrel 17 is detected by, for example, a rotary encoder, and an energization stopping signal is produced when the amount of rotation reaches a predetermined value may also be applied.

Figure 4:
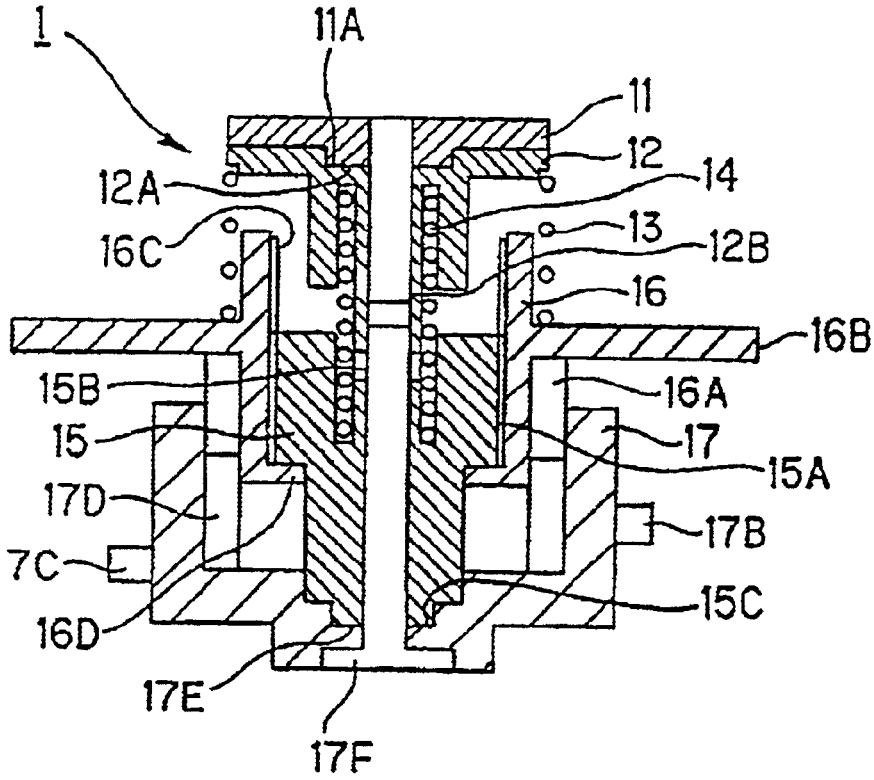
FIG. 4 is a sectional view showing the cam driving section according to the first embodiment of the invention.

FIG. 4 shows a vertical section of the cam driving section 1 wherein illustration of the frame 4, the torque transmitting section 3, the revolving shaft 3A, and the engaging pin 3B are omitted for simplicity of explanation. In the same figure, the barrel 15 forms a free wheeling clutch as a result of engaging an engaging projection 15C defined on the lower part thereof with an engaging projection 17E defined in the barrel 17, whereby the barrel 15 becomes either a coupling state (a state where a torque is transmitted) or an uncoupling state (a state where no torque is transmitted) dependent upon a rotating direction of the barrel 17. Furthermore, the barrel permits displacement towards the vertical direction due to engagement of the comb-shaped annular projection 15B with the comb-shaped annular projection 12B defined on the barrel 12 in case of operation in uncoupling sate with respect to the barrel 17. The barrel 16 is energized downwards by the spring 13 mounted in between the barrel 12 and the barrel 16, whereby the projection 16A is allowed to be in closely contact with the projection 17D defined on the inner circumference of the barrel 17, so that the cam section 16B is placed at a position of a predetermined height in the vertical direction thereof. Moreover, the barrel 16 is provided with the stopper 16D on the lower part thereof, whereby the barrel 15 sliding along the spline 16C is prevented from dislocation of the barrel 15 towards the bottom direction.

Figure 5:
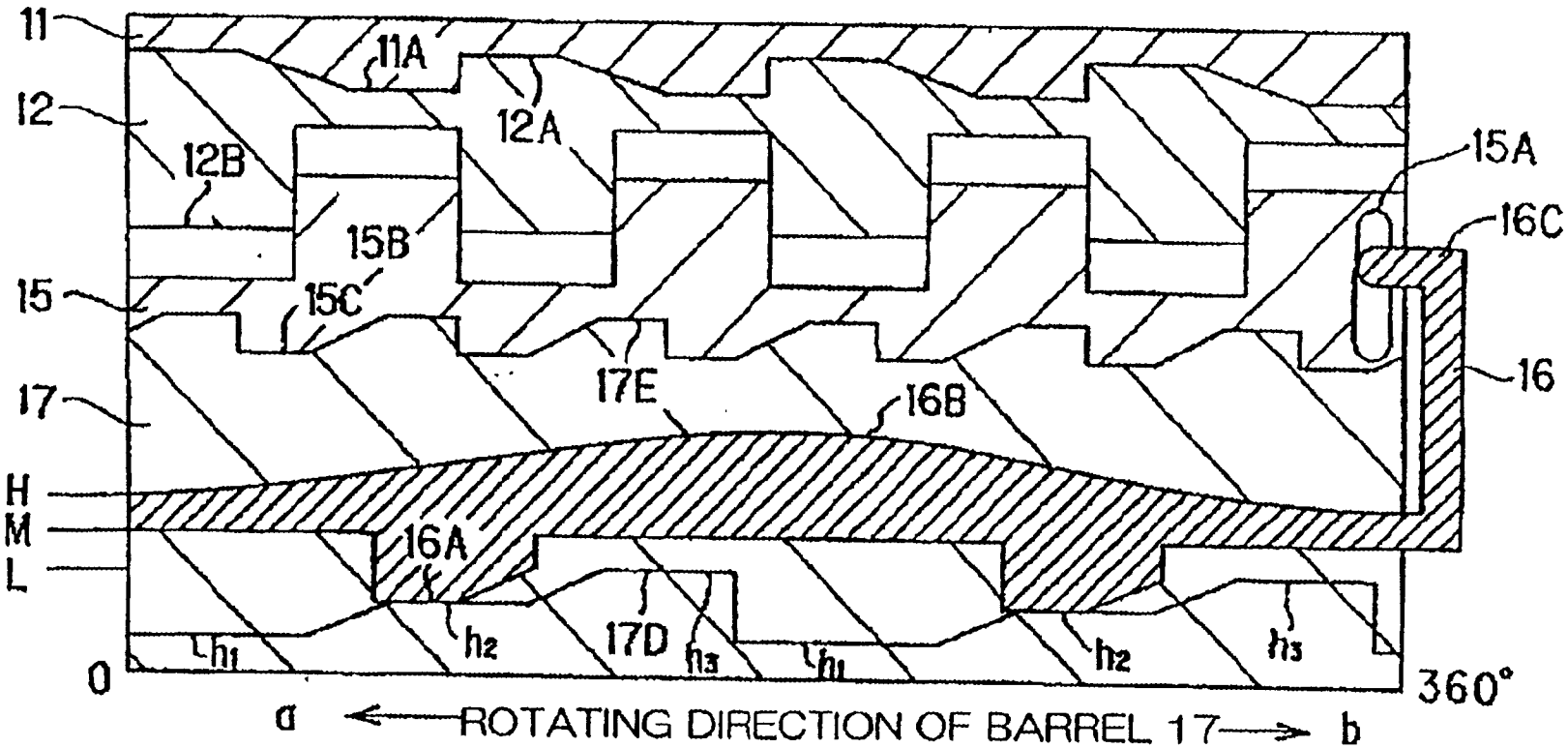
FIG. 5 is an explanatory view illustrating engaged conditions of respective sections of the cam driving section according to the first embodiment of the invention.

FIG. 5 shows engaging states in respective sections of the cam driving section 1 in a manner developed in the circumferential direction at 360 degrees wherein the cam section 16B of the barrel 16 is placed at a position M. The projection 17D is formed so as to have three gradations of height, i.e., $h_1$, $h_2$ and $h_3$, so that the projection 16A of the barrel 16 is placed at a position of the projection 17D having a height $h_2$. The number of gradations may be increased or decreased according to need.

When the barrel 17 is rotated in the direction a, the barrel 17 comes to be in an uncoupling state with the barrel 15, while the barrel 12 comes to be in a coupling state with the stopper 11, whereby the barrel 16 does not rotate to produce displacement in the perpendicular direction. When the barrel 17 rotates from the position shown in the figure towards the direction indicated by the arrow a, the barrel 16 is placed at a position of the height $h_3$ of the projection 17D. When the rotation continues further, the barrel 16 is placed at a position of the height $h_1$.

On one hand, when the barrel 17 rotates in the direction indicated by the arrow b, the barrel 17 becomes in a coupling state with the barrel 15, while the barrel 12 becomes in an uncoupling state with the stopper 11, whereby a torque is transmitted from the barrel 17 to the barrel 15, so that the torque is transmitted from the spline 15A of the barrel 15 to the barrel 16 through the spline 16C of the barrel 16, and finally the barrel 16 rotates together with the barrel 17.

Figure 6:
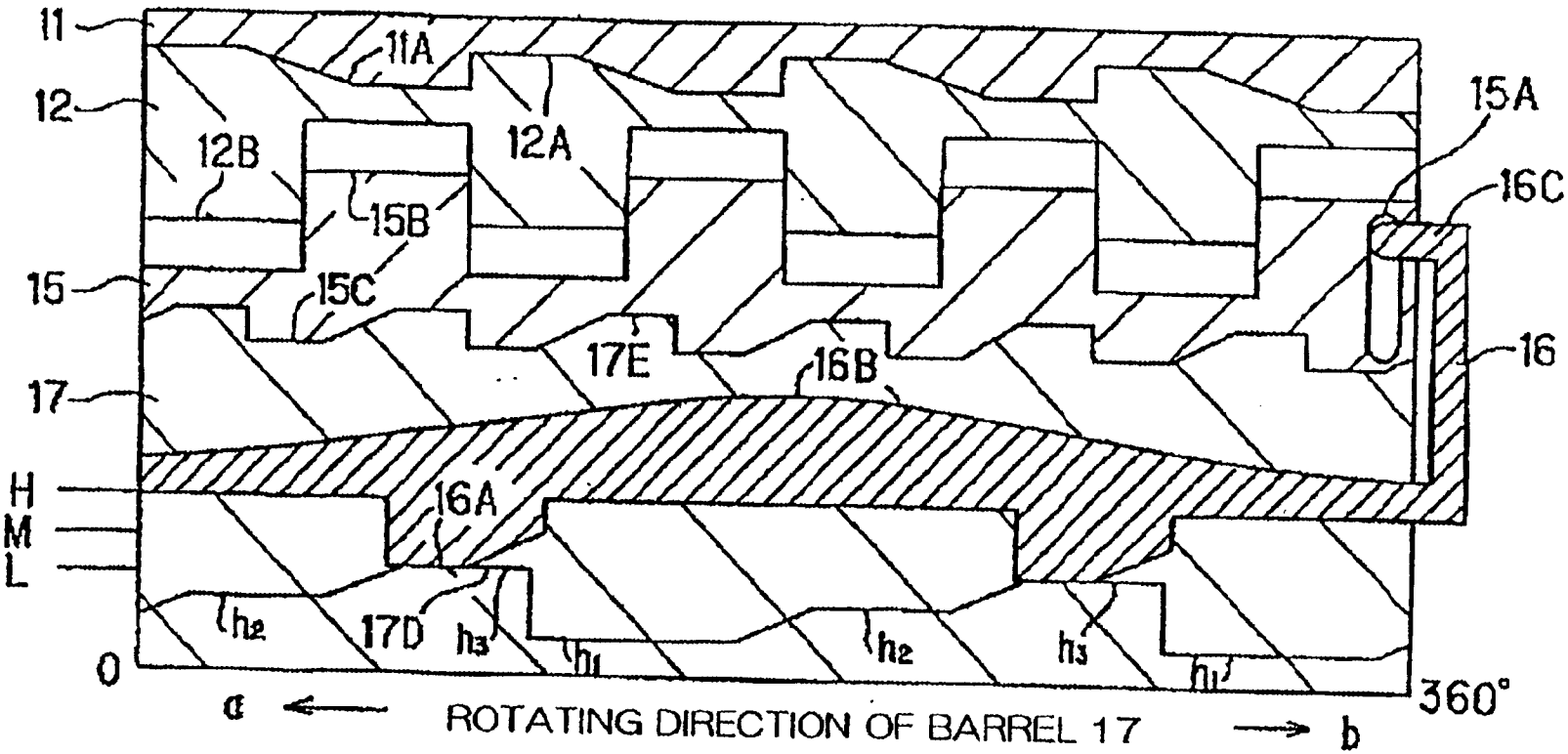
FIG. 6 is an explanatory view illustrating engaged conditions of respective sections of the cam driving section according to the first embodiment of the invention.

FIG. 6 illustrates a condition where the projection 16A of the barrel 16 is placed at a position of the height $h_3$ of the projection 17D, so that the cam section 16B of the barrel 16 is placed at the position H.

Figure 7:
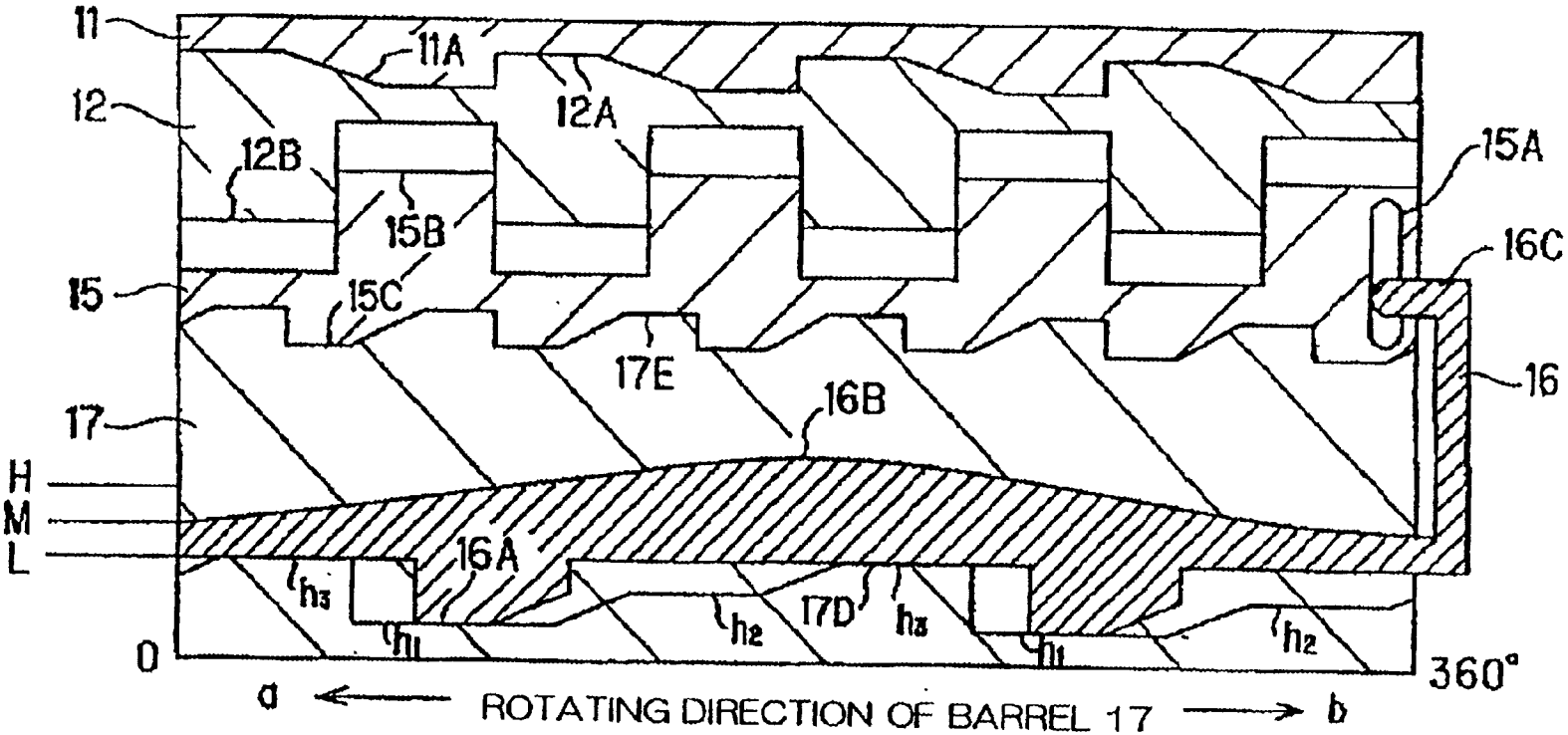
FIG. 7 is an explanatory view illustrating engaged conditions of respective sections of the cam driving section according to the first embodiment of the invention.

FIG. 7 illustrates a condition where the projection 16A of the barrel 16 is placed at a position of the height $h_1$ of the projection 17D, so that the cam section 16B of the barrel 16 is placed at the position L.

Figure 8:
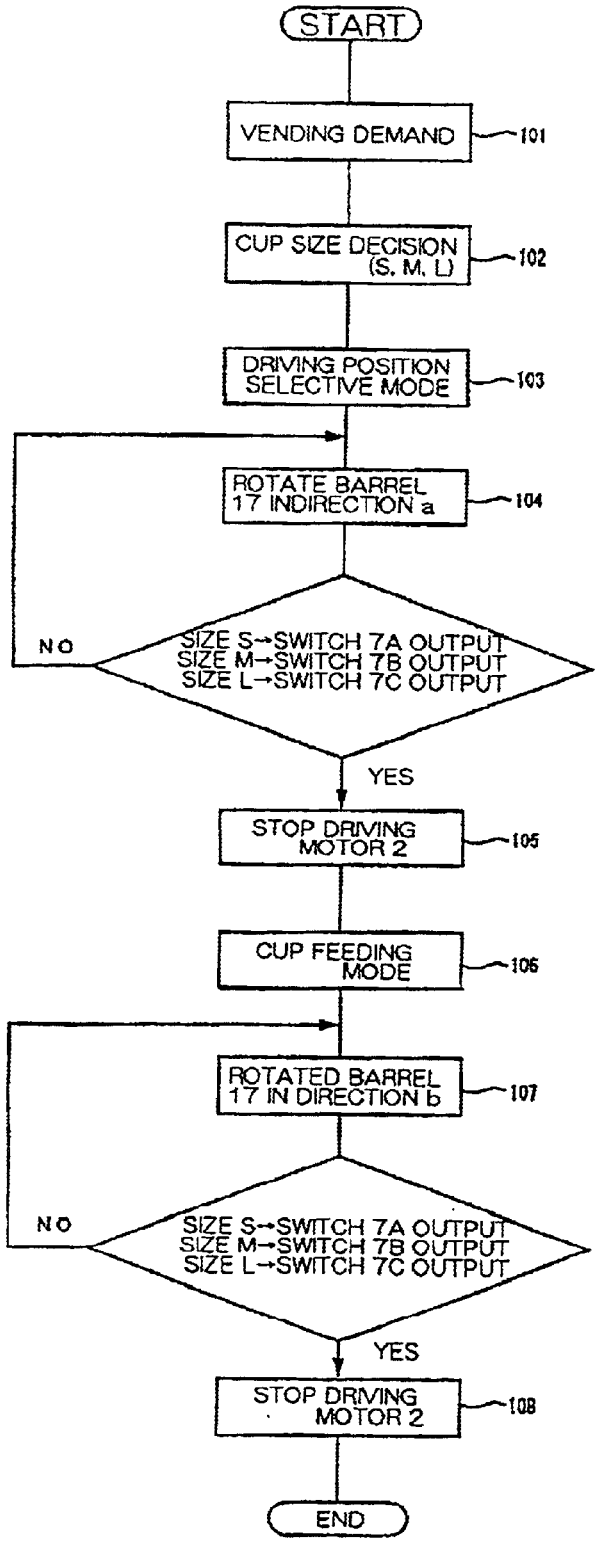
FIG. 8 is a flowchart in operation for dispensing cups in an automatic vending machine for dispensing cup-shaped containers according to the first embodiment of the invention.

FIG. 8 shows a flowchart in an operation for dispensing a cup of an automatic vending machine for dispensing cups provided with the above described selective actuating apparatus. Operation of the selective actuating apparatus will be described herein on the basis of the same figure.

When a purchaser pushes a vending button for beverage contained in a cup disposed on an automatic vending machine, a vending demand signal in response to the selected beverage contained in a cup is output to a vending control section (not shown) (step 101). The vending control section decides a cup size in response to the selected beverage to be contained in the cup based on the vending demand signal (step 102) to execute a driving position selecting mode (step 103). If a cup having size S is selected, the barrel 17 is rotated in the direction a by energizing the driving motor 2 of the cam driving section 1 (step 104). When the barrel 17 is rotated in the direction a, the barrel 16 shifts towards the perpendicular direction, and the cam section 16B of the barrel 16 is placed at the position H where the slider 6C has been disposed. When the cam section 16B is placed at a position of a predetermined height, the projection 17A formed on the barrel 17 is in contact with the switch plate 7*a* to turn ON the switch 7A, whereby an energization stopping signal is output to stop energization with respect to the driving motor 2 (step 105). When the barrel 16 is placed at a position of a predetermined height, the vending control section executes a cup feeding mode (step 106). In the cup feeding mode, cups stacked in a layer in every predetermined sizes are separated one by one for feeding the same in a cup dispensing section. In a cup dispensing operation for the cup 24 having size S, the driving motor 2 of the cam driving section 1 is energized to rotate the barrel 17 in the direction b (step 107). When the barrel 17 is rotated in the direction b, the barrel 16 rotates at a position H where the slider 6C is placed, whereby the cam section 16B pushes the slider 6C, so that the pin 53 fixed to the lever 52 in the cup dispensing section 5C is driven to implement an operation for dispensing the cup 24 in the cup dispensing section 5C. As a result of one revolution of the barrel 16, the projection 17A formed on the barrel 17 comes to be in contact with the switch plate 7*a* to turn ON the switch 7A, whereby an energization stopping signal is output to stop energization with respect to the driving motor 2 (step 108).

Figure 9:
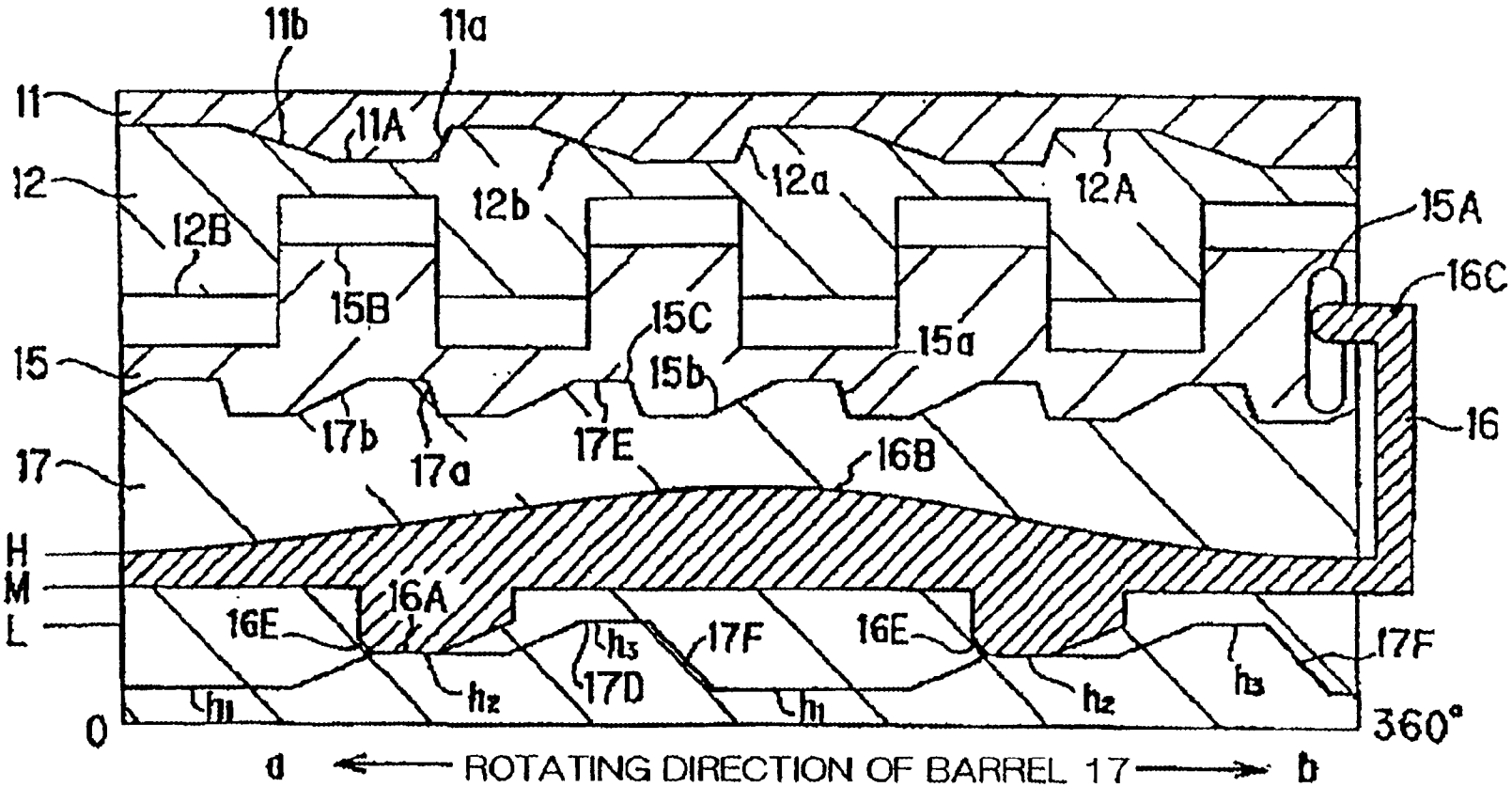
FIG. 9 is an explanatory view illustrating another constitution of a cam driving section according to the first embodiment of the present invention.

FIG. 9 shows another constitution of the cam driving section 1 wherein engaging states in respective sections of the cam driving section 1 is developed in the circumferential direction at 360 degrees for simplicity of an explanation. The engaging projection 11A of the stopper 11 described in FIG. 3 contains an inclined surface 11*a* defined and an inclined surface 11*b* defined with a more gradual inclined angle. The inclined surfaces 11*a* and 11*b* are defined so as to engage with inclined surfaces 12*a* and 12*b* defined in the same configurations as that of the inclined surfaces 11*a* and 11*b* in the engaging projection 12A of the barrel 12, respectively. In this condition, when the barrel 12 is in contact two- or one-dimensionally with the stopper 11, it is prevented from occurrence of sounds in impingement in the case where the barrel 12 rotates in an uncoupled state.

Moreover, the same configuration as those described above are applied also to inclined surfaces 15*a* and 15*b* defined on the engaging projection 15C of the barrel 15 as well as to inclined surfaces 17*a* and 17*b* defined on the engaging projection 17E of the barrel 17, so that it is prevented from occurrence of sounds in impingement in case of rotating the barrel. The barrel 16 has a chamfered plane 16E in the projection 16A, while the barrel 17 has a chamfered plane 17F in the projection 17D.

The cam driving section 1 reduces a shock appeared in case of lowering the barrel 16 and prevents from occurring of sounds in impingement, since the barrel 17 lowers along the chamfered plane 17F in the case where the barrel 17 rotates in the direction a in a driving position selecting mode, so that the projection 16A of the barrel 16 lowers from the position $h_3$ of the projection 17D to the position $h_1$. As a result of defining the chamfered plane 16E on the projection 16A, a plane pressure applied to the chamfered plane 17F decreases, so that its wear can be suppressed.

According to the above described selective actuating apparatus, it is arranged in such that a selecting operation for selecting a cup dispensing section from a plurality of cup dispensing sections as well as a driving operation for driving the so selected one of cup dispensing sections are selectively carried out due to first and second rotating directions of the driving motor 2, whereby it becomes possible to drive a plurality of the cup dispensing sections 5A, 5B and 5C by means of a single driving motor 2. As a result, the number of parts constituting a driving system may be reduced, whereby the resulting automatic vending machine can be downsized. In the above described automatic vending machine for dispensing cup-shaped containers, while it has been constituted in such that the cam section 16B is defined on the barrel 16, and revolving movement is converted into reciprocating motion on the basis of an amount of eccentricity in the cam, it may be, for example, constituted in such that a gear is prepared in place of the cam, and it is allowed to mesh with another gear provided on a side to be driven, thereby to transmit a driving force.

Furthermore, when it is arranged in such that a chamfered plane 16E is defined on the projection 16A of the barrel 16, and the barrel 16 is allowed to lower while sliding the same along the chamfered plane 17F defined on the projection 17D in the case where the barrel 16 is lowered from the position H to the position L, impingement in between the projection 16A and the projection 17D can be prevented, so that noise is reduced.

Figure 10:
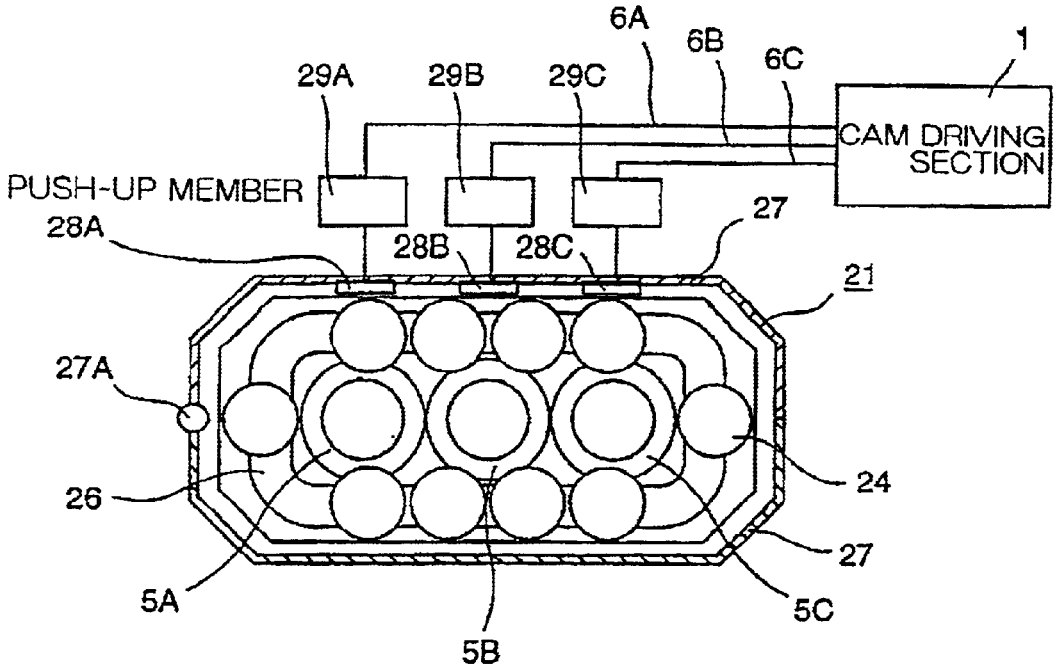
FIG. 10 is an explanatory view showing a cup containing section according to a second embodiment of the present invention.

FIG. 10 shows a cup containing section 21 according to a second embodiment of the present invention wherein cups 24 stacked in a layer in every sizes S, M and L are contained circularbly around cup dispensing sections 5A, 5B and 5C. The cup containing section 21 comprises an endless conveyor 26 for circulating the cups 24; restocking doors 27 for opening and closing in case of restocking the cups 24 and supported closably with a hinge 27A; cup transferring mechanisms 28A, 28B and 28C disposed on one of the restocking doors 27 and transferring horizontally a cup 24 on the conveyor 26 to predetermined any of the cup dispensing sections 5A, 5B and 5C having a size corresponding to the cup on the conveyor 26; and push-up members 29A, 29B and 29C for transmitting vertically a driving force in horizontal direction transmitted from a cam driving section 1 through sliders 6A, 6B and 6C in response to a configuration of the cup transferring mechanisms 28A, 28B and 28C. Since a constitution and functions of the cam driving section 1 are the same as that described in the first embodiment, overlapped explanations are omitted.

Figure 11:
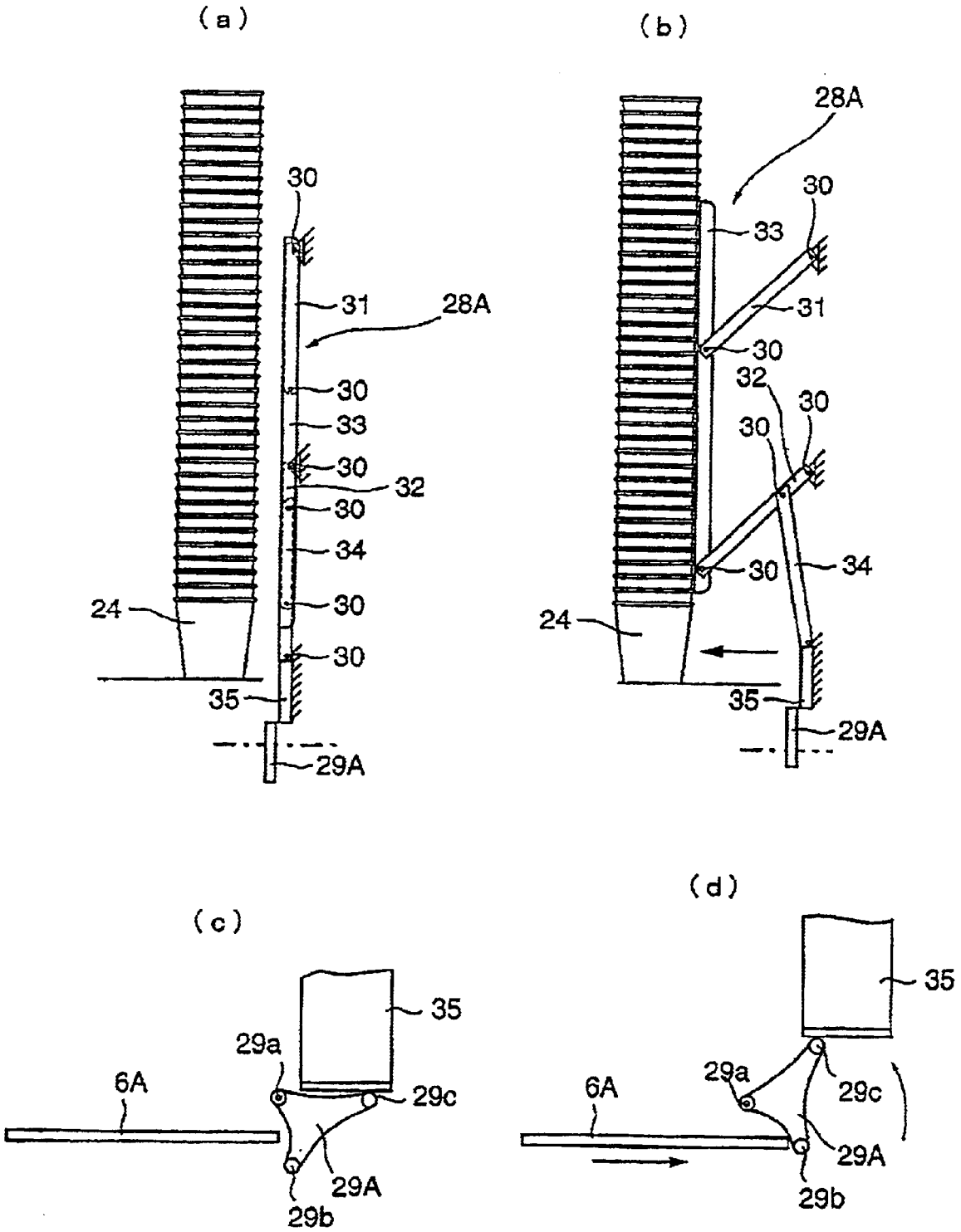
FIG. 11(*a*) is a side view showing a cup shifting mechanism according to the second embodiment of the invention.
Figure 12:
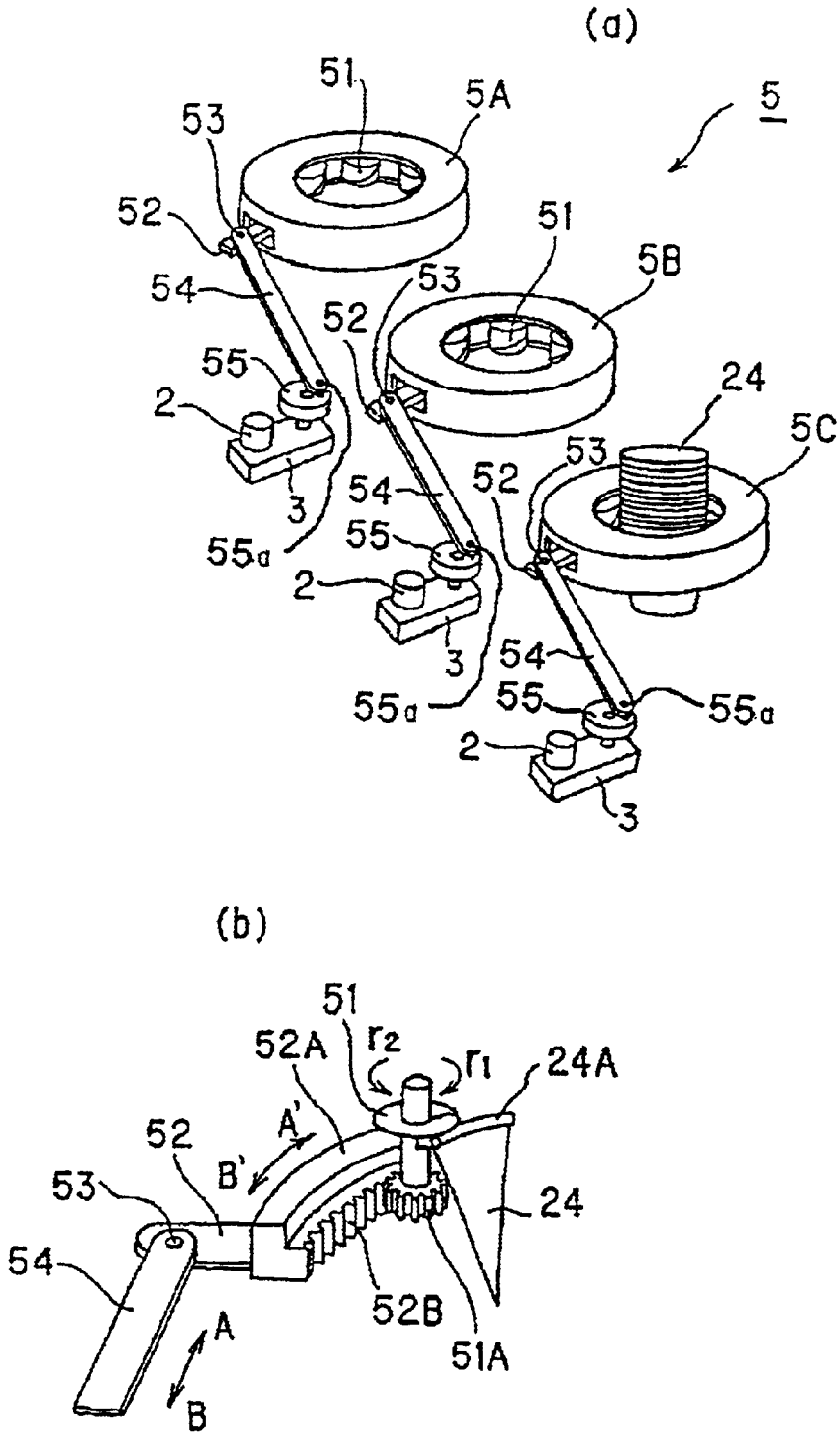
FIG. 12(*a*) is a perspective view showing a conventional cup feeding section.

FIG. 11(*a*) shows the cup transferring mechanism 28A viewed from the side thereof and which comprises links 31 and 32 supported rotatably by pins 30, respectively, with respect to a fixed system; a pushing plate 33 being supported rotatably by the pins 30 with respect to free ends of the links 31 and 32; the push-up member 29 for transmitting vertically a driving force transmitted from the cam driving section (not shown); and a driving slider 35 for transferring upwards a link 34 connected with the pin 30 as a result of being pushed up by the push-up member 29A wherein the driving slider 35 is supported by a fixed system so as to be movable in a vertical direction.

FIG. 11(*b*) illustrates a driving state of the cup transferring mechanism 28 wherein when the driving slider 35 is pushed up upwards by means of the push-up member 29A, the link 34 is allowed to rotate the link 32 in clockwise direction to transfer the pushing plate 33 towards the left side in the drawing, whereby the stacked cups 24 in a layer are transferred horizontally to a cup dispensing section (not shown).

FIG. 11(*c*) illustrates an undriven state of the push-up member 29 wherein the push-up member 29A is placed in a state shown in the figure with a layout of a supporting portion 29*a* as its axis in the case where the cup transferring mechanism is not driven.

FIG. 11(*d*) illustrates a state in case of driving the push-up member 29 wherein when the slider 6A transfers in a direction indicated by an arrow in case of driving a cup driving mechanism, the slider 6A abuts upon a part extending from the supporting portion 29*a* to a protruding portion 29*b* in the push-up member 29A, whereby the push-up member 29A rotates on the supporting portion 29*a* as its axis in counterclockwise direction, so that the driving slider 35 is pushed up upwards by means of the extreme end portion 29*b*.

According to the above described cup containing section 21, it is possible that a plurality of the cup transferring mechanisms 28A, 28B and 28C is selectively driven by a single driving motor, so that simplification and downsizing of the constitution are achieved.

In the preferred embodiments of the present invention, while a constitution for driving cup dispensing sections as well as cup transferring mechanisms to be disposed in a cup containing section of an automatic vending machine for dispensing cup-shaped containers has been described, the invention may be applied to a vending mechanism for a can rack containing canned beverage such as canned beer, and canned soft drink, as well as a vending mechanism for a commercial product containing section for containing box-shaped products such as cigarettes, whereby a plurality of vending mechanisms can be selectively driven by a single motor, so that the number of parts for such vending mechanisms can be reduced to downsize its driving system, besides a cost for apparatus can be reduced.

As described above, a selective actuating apparatus of the present invention comprises a first rotating member rotated by a torque transmitted; a second rotating member disposed coaxially with respect to the first rotating member; a free wheeling clutch means placed in between the first rotating member and the second rotating member and transmitting the torque of the first rotating member to the second rotating member in the case when the first rotating member rotates in a first rotating direction; and a displacing means disposed in between the first rotating member and the second rotating member and displacing the second rotating member with the predetermined spacing in the predetermined direction due to a rotating operation of the first rotating member in the case when the first rotating member rotates in a second rotating direction; the second rotating member selecting the one actuating member at a position in the predetermined direction determined as a result of displacement by the displacing means, and being constituted so as to actuate the one actuating member by means of the torque transmitted through the free wheeling clutch means. Thus, according to the selective actuating apparatus of the invention, a plurality of objects to be driven can be driven without requiring a plurality of driving sources, so that its driving system can be downsized.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A selective actuating apparatus for a cup dispenser wherein one of a plurality of actuating members disposed with a predetermined spacing in a predetermined direction is selected, each actuating member is configured to dispense a cup and the selected said one of a plurality of actuating members is actuated due to a torque obtained by a single motor, comprising:

a first rotating member rotated by said torque transmitted;

a second rotating member disposed coaxially with respect to said first rotating member;

a free wheeling clutch means placed inside said first rotating member for transmitting the torque of said first rotating member to said second rotating member when said first rotating member rotates in a first rotating direction; and a displacing means disposed in between said first rotating member and said second rotating member for displacing said second rotating member with said predetermined spacing in said predetermined direction due to a rotating operation of said first rotating member when said first rotating member rotates in a second rotating direction;

said second rotating member selecting said one of a plurality of actuating members at a position in said predetermined direction determined as a result of displacement by said displacing means, and being constituted so as to actuate said one of a plurality of actuating members by means of said torque transmitted through said free wheeling clutch means, wherein said free wheeling clutch means includes a first engaging projection formed on a barrel located inside said first rotating member, and a second engaging projection defined in said first rotating member, and said displacing means includes a stepped part defined in a stepped contour on the inner circumference of said first rotating member with a step corresponding to said predetermined spacing, and a projecting part defined on the outer circumference of said second rotating member, the projecting part configured to engage with said stepped part, and said first rotating member rotates when rotated in said second rotating direction in a condition where no torque is transmitted to said second rotating member as a result of uncoupling of said free wheeling clutch means, and displaces said second rotating member with said predetermined spacing in said predetermined direction as a result of sliding of said projecting part, defined on the outer circumference of said second rotating member, along said stepped part.

2. The selective actuating apparatus for a cup dispenser as claimed in claim 1, wherein said second rotating member is provided with a cam section for displacing said one of a plurality of actuating members against elastic force in a direction intersecting said predetermined direction at right angles as a result of rotating said second rotating member in said first rotating direction.

3. The selective actuating apparatus for a cup dispenser as claimed in claim 1, wherein said first rotating member contains a wall surface formed by an inclined plane extending from the highest step to the lowest step in said stepped part.

* * * * *